US005975363A

United States Patent [19]

Haycock

[11] Patent Number: 5,975,363

[45] Date of Patent: Nov. 2, 1999

[54] DEVICE FOR AIDING IN EXPELLING THE CONTENTS OF A COLLAPSIBLE TUBE

[76] Inventor: Steven M. Haycock, 46119 Pickford, Northville, Mich. 48167

[21] Appl. No.: 09/097,085

[22] Filed: Jun. 12, 1998

[51] Int. Cl.[6] ..... B65D 35/28

[52] U.S. Cl. ..... 222/103

[58] Field of Search ..... 222/103, 92

[56] References Cited

U.S. PATENT DOCUMENTS

| | | | |
|---|---|---|---|
| 1,949,607 | 3/1934 | Harrold | 222/103 |
| 2,678,755 | 5/1954 | Buras, Jr. | 222/103 |
| 2,790,579 | 3/1957 | Woldorf | 222/103 |
| 3,675,822 | 7/1972 | Casali et al. | 222/103 |
| 4,365,727 | 12/1982 | Schmelkin | 222/103 |
| 5,145,093 | 9/1992 | Zeller | 222/103 |
| 5,248,065 | 9/1993 | Zima | 222/103 |
| 5,322,194 | 6/1994 | Roberts | 222/103 |
| 5,743,434 | 4/1998 | Light | 222/103 |
| 5,890,625 | 3/1999 | De Laforcade | 222/103 |

*Primary Examiner*—Andres Kashnikow
*Assistant Examiner*—David Deal
*Attorney, Agent, or Firm*—John R. Benefiel

[57] ABSTRACT

A device used as an aid for squeezing the contents from a tube of toothpaste includes a spring clip engageable with the folded end of the tube. Flat tabs are pivoted to the spring clip, and in a flipped forward position overlie the tube sides to facilitate flattening of the tube as material is squeezed out. In a flipped back position the tabs facilitate opening of the spring clip jaws for reinstallation on a further rolled up end of the tube.

4 Claims, 1 Drawing Sheet

DEVICE FOR AIDING IN EXPELLING THE CONTENTS OF A COLLAPSIBLE TUBE

FIELD OF THE INVENTION

The present invention relates to a device intended to facilitate the manual squeezing out of the contents of a flexible tube of the type used for toothpaste.

DESCRIPTION OF THE PRIOR ART

The prior art contains many devices for expressing toothpaste from collapsible tubes either by rolling on a core (U.S. Pat. No. 4,576,314), squeezing through an orifice (U.S. Pat. Nos. 5,222,629; 4,778,082), rolling or collapsing the tube in increments and then using a rigid clip to maintain the reduced volume tube (U.S. Pat. Nos. 5,442,839; 5,549,221; 3,536,234), or containment of the complete flexible tube in a rigid device that is then pushed on in some way to dispense the paste (U.S. Pat. Nos. 5,145,093; 4,019,656; 4,565,303).

However, none of the prior art devices heretofore developed have enjoyed widespread acceptance in the current commercial market. All of the above-referenced prior art devices have shortcomings that have kept them from common acceptance including: Complicated design devices with multiple parts which in turn presents difficulty in disengaging and re-adjustment on the tube; very small devices that are difficult to disengage and re-adjust on the tube; devices that do not remain attached to the lapped end of the tube since flexible tubes are now commonly produced from plastic and will not very easily retain their original shape, thus pulling free from the retaining devices.

It is the object of the present invention to provide a simple low cost device which is effective to aid in expelling the contents of a collapsible tube and maintains the tube in a neat condition, ready for the next dispensing of material.

SUMMARY OF THE INVENTION

The above object is achieved by a spring clip engageable with a lapped tube end, and a pair of planar tabs each attached to a wire bail for each jaw of the spring clip. In a flipped forward position, the tabs each overlie one side of the tube, enabling squeezing of the tube by pressure exerted on the tabs to expel material. In a flipped back position, the tabs are used to operate the spring clip, allowing its jaws to be easily opened to allow removal. The empty tube section is folded up and by squeezing the flipped back tabs, the spring clip may be reinstalled gripping the lapped tube end. The planar tabs may be imprinted with an advertising message.

The tube is thus maintained in a ready to use condition and has a neat appearance at all times as the contents are used up.

DETAILED DESCRIPTION OF THE PREFERRED EMBODIMENT

Figures 1, 2, 3, 4, 5, 6:
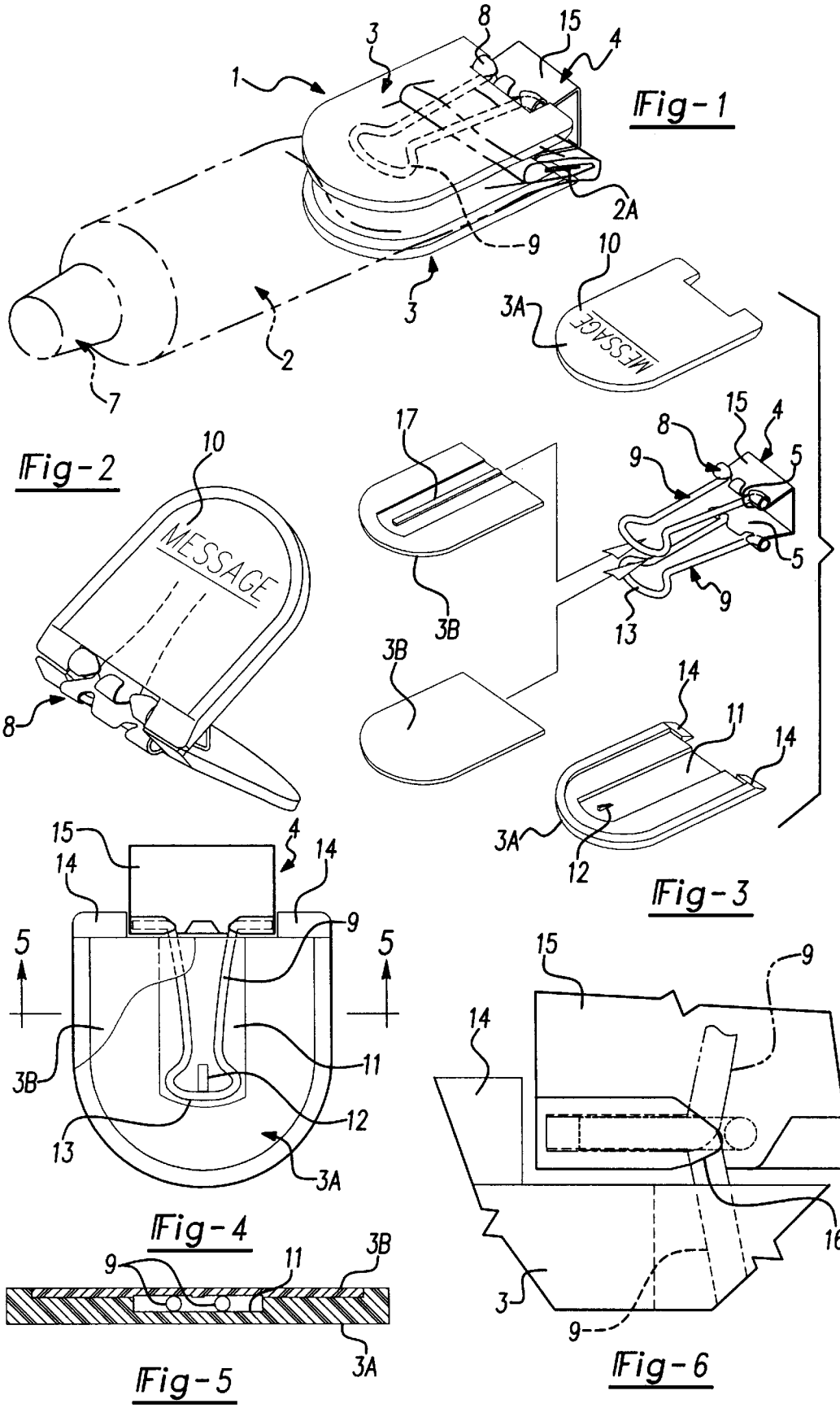
FIG. 1 is a perspective view of the device of the present invention in use squeezing a collapsible tube, shown in phantom.
FIG. 2 is a perspective view of the device of the present invention showing the paddles flipped back preparatory to being placed on the folded end of a collapsible tube.
FIG. 3 is an exploded perspective view of the device.
FIG. 4 is a plan view of the device according to the present invention with portions partially broken away showing the spring clip portions required within the paddles.
FIG. 5 is a view of the section 5—5 in FIG. 4.
FIG. 6 is an enlarged fragmentary view of the spring clip showing alternate positions of the wire bail, detented by the shape of the rolled edge of the clip.

Referring to drawings, FIGS. 1–5, the device 1 is adapted to facilitate squeezing a collapsible tube 2 having a dispenser outlet top 7. The device is useable with any collapsible tube 2 containing any viscous materials, but the most common use would be with tubes of toothpaste.

As shown in FIG. 1, the material (paste) is easily expressed from the tube 2 by applying a squeezing pressure with the thumb and forefinger on either side of flipped forward tabs 3 of the device 1 together, the section of the tube 2 between the tabs 3 thereby collapsed as the paste is expelled. The paste is constrained to move out the outlet top 7 rather than unrolling the tube by the action of a spring clip 4 gripping the rolled or folded tube end 2A preventing the paste from re-entering the flattened sections of the tube 2. As the paste is expressed from the tube outlet 7, and each section of the collapsed tube 2A is depleted, the spring clip 4 must be repeatedly removed and reinstalled. This is done by flipping the tabs 3 back around the rolled edge hinges 8 on either side of the clip 4. When the tabs 3 are squeezed together, pressure is applied against the underside of the opposing tabs 3, the jaw portions of the clip 4 are opened. The tube 2 is removed from the clip 4, and the collapsed portion of the tube can then be lapped or folded, and the jaws 5 of the clip re-installed onto the lapped end of the tube 2A to retain the clip 4 in place.

The opposing tabs 1 are rotated around the hinges 8, and held in the flipped forward position on either side of the tube 2 by a detent action created by the clip 4. This procedure is repeated as the paste is progressively expressed from the tube 2 until the contents of the tube have been depleted.

The spring clip 4 incorporated into the device of the present invention is itself well-known and is widely used as a paper binder clip. The spring clip 4 can be as wide as the collapsible tube 2 with which it is to be used. In practice, however, the clip width needs only to have jaws wide enough, and/or with a sufficiently roughened jaw biting surface to remain fixed to the tube 2, and lapped tube portion 2A without moving or releasing when the opposing leaves 1 are forced together. The preferred clip width (to apply sufficient jaw force) is approximately 50% of the total tube width. The spring clip jaw opening should be sized for proper function of the device in question depending on the length of the collapsible tube 2. If the jaw opening is too small, the tube 2 will become too thick to be clipped as the end of the tube 2 is repeatedly folded. Likewise, if the clamp jaws 5 opening is too wide, they will not properly clamp the tube end when the jaws are attached on a full tube 2. The jaw opening, and height of the back of the metal tension clip, must be approximately equal to the thickness of the lapped 2A portion of the tube 2 when attached to the lapped tube 3 in the most forward tube position. For most commercially sold toothpaste collapsible tubes, the preferred clip "back height" has proven to be approximately ⅝ ths of an inch.

The spring clip design is important and must provide the necessary jaw force, along with the height and width dimensions of the clip 4. The clip 4 includes a pair of U-shaped wire bails 9 which have legs inserted in a rolled edge of the clip body 15 to be pivotally attached. The length of the wire bails 9 of the spring clip 4 should be sufficient to allow proper functioning of the device in that the wire bails must hold the tabs 3 in an open position when the jaws are being opened, and the wire bails 9 must keep both tabs 3 secure against either side of the tube 2 when the clamp 4 is fixed to the end of the tube 2A for ease of applying squeezing pressure to the tube 2. In addition, the wire bails 9 each act as support for one of the molded plastic tabs 3, and must be of a proper length to support approximately ¾ of the length of the plastic tabs 3. The wire diameter must be the proper size to provide tab 3 support. The preferred diameter of the wire bails 9 has been found to be approximately 0.050 inches.

The tabs 3 can be molded of many types of plastic, however to maximize the flatness of the surface and optimize the quality of the print the preferred material is low shrinkage ABS or High Impact Styrene plastic. Print "message" characters 10 and/or graphics may contribute to the successful commercialization of the device, and can be printed on one or both sides of the tube clip device 1 as shown.

The width of the tabs 3 should be equal to or slightly smaller than the diameter of the flexible tube 2 before any of the paste is expressed from the tube top outlet. Likewise, the device 1 width should cover approximately 75% of the width of the lapped portion of the tube 2 when the clip 4 is attached to the center of the bottom lapped tube 2A. The length of the tabs 3 must be long enough to provide several average quantity uses of paste before having to remove the device from the tube, and at the same time empty approximately ¼ to ⅜ inch of the flattened tube before requiring resetting of device 1. In this manner of use, the tube 2 can be lapped one section at a time before reinstalling the clip 4 to the lapped tube end 2A.

The tabs 3 when designed for use in conjunction with a standard size commercial tube of toothpaste, should preferably be approximately 1⅜ inches wide and 1⅜ inches long from the top of the circumference on one end to the top of the ears on the other end.

The tabs 3 are constructed of two parts 3A, 3B. The main part 3A has a recess 11 sized to receive a wire bail 9 with a catch projection 12 hooking the upper looped end 13. A cover 3B part is bonded either adhesively or ultrasonically over the recess 11 capturing a wire bail 9. Loctite 401 adhesive has been successfully used with high impact Styrene.

The spring clip body is captured between a pair of projections 14 on the tab main part 3A.

FIG. 6 shows the detenting mechanism of the spring leg of the wire bail 9 in as the bail is flipped in either direction, capturing the bail 9 in either position. This of course is well-known per se in spring binder clips used.

The present device has been shown to be a very practical, inexpensive and an easily used aid in the dispensing of paste from a flexible tube. The device fits totally within the confines of the tube shape during the entire period of when the tube is being emptied, helps to insure the most efficient use of the paste by continually lapping and clamping the lapped tube in place, and can be molded in color and/or printed on further enhancing the appearance of the device in use.

While having shown and described an embodiment of this invention in some detail, it will be understood that this description and illustrations are offered merely by way of example, and that the invention is to be limited in scope only by the appended claims.

I claim:

1. A device for dispensing paste from a collapsible tube having a thin closed rearward end, an open forward end opposite the closed end and a cylindrical flexible tube portion extending from the closed end to the open end when the tube is full of paste, the closed end capable of being lapped in a series of flat portions folded toward the open end and ending with a last flat portion when the collapsible tube is nearly empty of paste, said device comprising:

a first planar tab member;

a second planar tab member in spaced relation to the first planar tab member; and a spring clip having a width portion extending less than the width of the closed end of the tube, said first and second planar members pivotally connected to jaw portions of said spring clip, said jaw portions having an open predetermined condition permitting said jaws to be placed onto a folded rearward closed end of the tube, and in a second predetermined condition said jaws grip said folded end;

said first and second tab members pivoted to said spring clip so that in a first flipped forward position they overlie a respective side of said tube member to enable squeezing said tube, and in a second flipped back position may be used to operate said spring clip jaws.

2. A device for dispensing paste from a collapsible tube having a thin closed rearward end, an open forward end opposite the closed end and a cylindrical flexible tube portion extending from the closed end to the open end, the closed end capable of being lapped in a series of flat portions folded toward the open end and ending with a last flat portion, said device comprising:

a first planar tab member;

a second planar tab member in spaced relation to the first planar member;

a steel spring clip clamp device engaging the closed end of the tube;

first and second bail members attached to said clip said bail members connected to a respective one of said planar tab members so that when said planar members are pressed toward one another, the paste will be dispensed from the open end of the collapsible tube.

3. A device for dispensing paste from a collapsible tube having a thin closed rearward end, an open forward end opposite the closed end and a cylindrical flexible tube portion extending from the closed end to the open end, the closed end capable of being lapped in a series of flat portions folded toward the open end and ending with a last portion, said device comprising:

a first planar tab member;

a second planar tab member in spaced relation to the first planar member;

a clip engaging the closed end of the tube, said clip having movable jaws;

first and second bail members attached to said clip member, said first bail member connected to said first planar tab member and said second bail member connected to said second planar tab member so that when said movable jaws are separated to a first open position, said jaws engage the closed end of the tube and when said movable jaws are separated to a second open position which is greater than said first open position, said jaws of said clip are capable of being removed from the closed rearward portion of the flexible tube and when said planar tab members are pressed toward each other, said planar tab members are contiguous to the sides of the collapsible tube.

4. The device according to claim 3 wherein said tab members are imprinted with graphic material.

* * * * *